United States Patent [19]

Hara et al.

[11] Patent Number: 4,568,207

[45] Date of Patent: Feb. 4, 1986

[54] MAGNETIC ACTUATOR MECHANISM

[75] Inventors: Kazuhiko Hara, Neyagawa; Fumihiro Kasano, Hirakata; Yoshinobu Okada, Shijonawate; Hiromi Nishimura, Takatsuki; Tadashi Murakami, Seto, all of Japan

[73] Assignee: Matsushita Electric Works, Ltd., Osaka, Japan

[21] Appl. No.: 614,640

[22] Filed: May 29, 1984

[30] Foreign Application Priority Data

May 27, 1983 [JP] Japan ..... 58-94587

[51] Int. Cl.[4] ..... B41J 3/12

[52] U.S. Cl. ..... 400/124; 101/93.05; 335/274

[58] Field of Search ..... 400/124; 101/93.05; 335/274, 275, 276

[56] References Cited

U.S. PATENT DOCUMENTS 3,217,640 11/1965 Bradshaw ..... 400/124 X 4,214,836 7/1980 Wang ..... 400/124

4,449,836 5/1984 Yamada ..... 400/124

*Primary Examiner*—Paul T. Sewell

*Attorney, Agent, or Firm*—Stevens, Davis, Miller & Mosher

[57] ABSTRACT

An improved magnetic actuator mechanism suitable for dot printing mechanisms for use in a wire matrix dot printer. The present magnetic actuator mechanism comprises an armature movable between a reset position and an actuated position, a permanent magnet for attracting the armature toward the reset position, and an electromagnet which, when energized, generates in the armature a magnetic flux opposite to and larger than the magnetic flux generated therein by the permanent magnet. The armature is thus moved to the actuated position by the turn of the magnetization direction in the armature when the electromagnet is energized. Therefore, in the present invention, the armature can have the magnetic fluxes in the opposite directions by the action of the permanent magnet and electromagnet combination so as to provide the armature of smaller cross sectional area or thickness with a higher magnetic force without causing the magnetic saturation thereof, which allows the use of an armature of less thickness or weight to assure high speed operation in response to a driving signal.

3 Claims, 23 Drawing Figures

MAGNETIC ACTUATOR MECHANISM

BACKGROUND OF THE DISCLOSURE

1. Fields of the Invention

This invention relates to magnetic actuators, more particularly to magnetic actuators suitable for actuating print wires in wire matrix dot printers.

2. Description of the Prior Art

Conventional magnetic actuators employed in print wire actuators for wire matrix dot printers can be broadly classified into two types. One is a non-polarized type as shown in FIG. 1; and the other a polarized type as shown in FIG. 3.

The former type of magnetic actuator is disclosed, for example, in U.S. Pat. No. 4,240,756, the relevant portion of which is reproduced in FIG. 1. As shown in the figure, the magnetic actuator comprises a generally U-shaped yoke 2 with a field coil 1 surrounding its one leg, and an armature 3 so arranged as to bridge both pole faces 2*a*, 2*b* of said yoke 2. The base portion of the armature 3 is pushed against the pole face 2*a* of said U-shaped yoke 2 by a compressor spring 4 and serves as a fulcrum of the armature 3. The free end portion of the armature 3 is normally biased away from the pole face 2*b* of the yoke 2 by the action of a wire return spring 5, such that an air gap <A> is formed between the pole face 2*b* of said U-shaped yoke 2 and the armature 3. Thus, the armature 3 is attracted toward the pole face 2*b* of the U-shaped yoke 2 when the field coil 1 receives a driving voltage. FIG. 2 shows the relationship between the magnetic flux <F> and the magnetomotive force <NI> generated by the field coil 1 within the range <Fa> of the magnetic flux. When the field coil 1 is de-energized, the armature 3 returns to its initial or reset position by the combined forces of the compressor spring 4 and the wire return spring 5. In the meanwhile, the armature for driving the wire actuator is required to be operated at a higher speed by repeated driving signals applied to the field coil 1 at a cycle of as high as from 0.7 to 1.0 KHz. However, it is known that the larger the mass of the armature, the longer the time required for the armature to respond to the driving signals. Therefore, the armature 3 is required to have a mass as small as possible for effecting high speed operation. For this purpose, an armature of less cross sectional area or thickness is found to be preferable. But unfortunately, the reduction in thickness can adversely reduce the magnetic path for the magnetic flux, rendering the armature liable to become magnetically saturated at only a small magnetic flux. Therefore, sufficient attraction force for wire dot printing is hardly expected with the armature of less thickness, which frequently results in blurred printed dots on a recording medium. Accordingly, in this prior art, the thickness of the armature should be decided rather by the requirement for obtaining sufficient impact power than by the requirement for enhancing the response speed. That is, the thickness of the armature cannot be reduced beyond a certain limit so as to compete with an increasing demand for much higher speed operation of the wire dot printing. On the other hand, the polarized magnetic actuator of the latter type is disclosed, for example, in U.S. Pat. No. 4,351,235. In this type, as schematically reproduced in FIG. 3, a permanent magnet 12 is disposed between parallel yokes 10 and 11 of different lengths. Provided at the free end portion of the longer yoke 10 is a core 13 which extends in parallel with the magnetic polarization direction of said permanent magnet 12 and is surrounded by a field coil 14. The upper end of the core 13 serves as a pole face and is spaced from the free end portion of the shorter yoke 11. An armature 15 secured on the shorter yoke 11 comprises a pole piece 15*a* and a resilient plate 5*b* made of elastic and magnetically permeable material. The base portion of the resilient plate 15*b* is secured to the yoke 11 in a cantilever fashion to be in parallel relation thereto and the free end portion of the resilient plate 15b carries the pole piece 15*a* which defines on their lower surface a pole face confronting the pole face of said core 13 and which forms on their upper surface means for printing a dot. Under an initial condition when the field coil 14 remains unexcited, the armature 15 is attracted against the restoring force of the spring plate 15*b* to the core member 13 due to the magnetomotive force of the permanent magnet 12. When the field coil 14 receives a driving voltage for generating a magnetomotive force to cancel that of the permanent magnet 12, said attraction force between the armature 15 and the core member 13 is weakened, which causes the armature 15 to move in the direction <P> due to the restoring force of the spring plate 15*b* and causes said means on the pole piece 15*a* to imprint a dot on the recording medium.

In this prior art, however, the electromagnetic force is only utilized to cancel or counteract the magnetic force of the permanent magnet retaining the armature in its reset position such that the dot printing is carried out by the restoring action of the resilient plate 15*b* and not by the electromagnetic force. This makes it difficult to attain a much higher printing speed as well as a strong printing force. In addition to the above, the permanent magnet 12 is in a constant magnetic circuit with the electromagnet of the core 13 and the coil 14 irrespective of the positions of the armature 15, reset or actuated. Accordingly, even if the electromagnet be utilized to overpower the permanent magnet, there should be required much electromagnetic force for repelling the armature to the actuated position against the attraction force resulting from the permanent magnet, which is disadvantageous in that the electromagnet requires much larger current so as to make slower the operation of the armature. Thus the prior art is found not to be satisfactory for effecting much higher armature operation as desired in a present-day dot printer.

SUMMARY OF THE INVENTION

The above drawback has been successfully removed in the present invention comprising an armature movable between a reset position and an actuated position, a permanent magnet which forms with said armature a resetting magnetic circuit for constantly attracting the armature to the reset position, and an electromagnet which forms with said armature an actuating magnetic circuit for generating in the armature a magnetic flux which is opposite to and larger than that generated in the armature by the permanent magnet such that the actuating magnetic circuit upon energization of the electromagnet will cause the armature to move to the actuated position. Therefore, in this invention, the armature can have the magnetic fluxes in the opposite direction by the action of the permanent magnet and electromagnet combination so as to provide an armature of less cross sectional area or thickness with a higher magnetic force without causing magnetic saturation thereof, which allows the use of an armature of less thickness or weight to assure high speed operation in response to a driving signal.

Besides, in the present invention, the magnetic flux of the electromagnet not only cancels the magnetic flux of the permanent magnet but also serves to drive the armature away from the permanent magnet, whereby the release of the armature from the permanent magnet is hastened.

In a preferred embodiment of the present invention, the magnetic actuator is provided with a yoke of generally U-shaped configuration comprising first and second legs connected by a web. A core member and a first pole piece extend orthogonally respectively from the intermediate portion and the free end portion of the first leg toward the second one, both being in parallel with the web and spaced from the second leg. The core member is surrounded by a field coil. A permanent magnet is magnetically connected at its one pole to the free end portion of the second leg. A second pole piece attached to the other pole of the permanent magnet confronts the first pole piece to define therebetween an air gap through which an armature extends. The armature is pivotally supported onto a support face, or a terminating face, of the core member. When the field coil remains unexcited, the armature is attracted to the second pole piece due to the attraction force of the permanent magnet. And when the field coil is excited so that the direction of the magnetic flux within the armature may be turned, the armature is released from the second pole piece so as to be substantially disconnected magnetically from the permanent magnet and attracted to the first pole piece at which the armature completes a magnetic circuit devoid of the permanent magnet. Thus, the magnetic actuator of the present invention can be made simple in construction for easy assembling.

Another feature of the above preferred embodiment resides in the employment of first and second springs connected to the armature on both sides of the portion pivotally supported onto the support face of the core member in such a manner that the first spring overpowers the second spring to bias the armature toward the reset position when the armature is in the actuated position while it is counteracted by the second spring when the armature is in the reset position. Therefore, when the field coil is de-energized, the armature is smoothly released by the biasing force of the first spring from the actuated position and restored to the reset position, while such first or return spring by no means impedes the motion of the armature from the reset position to the actuated position.

Additionally, in the above embodiment, means is introduced for adjusting the biasing force of the second spring counteracting the first spring such as to easily determine a critical point at which the armature is moved to the actuated position upon energization of the electromagnet, whereby an easy and exact adjustment for actuating the armature at a predetermined current level can be effected regardless of possible variations in the magnetic characteristics of the permanent magnet and the electromagnet.

It is therefore a primary object of the present invention to provide a magnetic actuator mechanism that is capable of responding rapidly to the driving signal by enlarging the permitted range of the magnetic flux in the armature without causing the magnetic saturation thereof.

It is another object of the present invention to provide a magnetic actuator mechanism which is of simple mechanical construction and is easy to assemble.

It is still another object of the present invention to provide a magnetic actuator mechanism that is capable of smoothly restoring the armature to the reset position.

It is a further object of the present invention to provide a magnetic actuator mechanism that is capable of easily and exactly providing a uniform response characteristic of the armature irrespective of the differences in magnetic characteristics of the permanent magnet and the electromagnet employed.

Other objects and advantages of the present invention will be readily understood from the detailed description thereon taken with the accompanying drawings.

BRIEF DESCRIPTION OF THE DRAWINGS

In the figures.

DESCRIPTION OF THE PREFERRED EMBODIMENT

Figure 4:
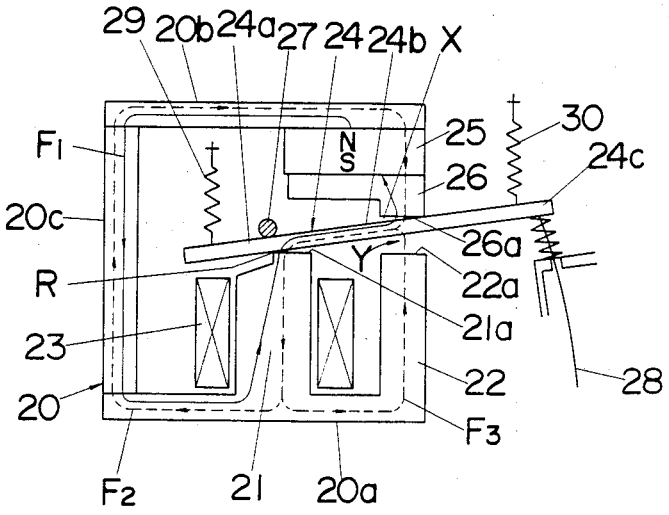
FIG. 4 is a schematic illustration of a magnetic actuator mechanism in accordance with one embodiment of the present invention.

Referring now to FIG. 4 illustrating a preferred embodiment of the present invention, a yoke 20 is generally of U-shaped configuration comprising first and second legs 20*a*, 20*b*, and a web 20*c*. A core member 21 and a first pole piece 22 extend respectively from the intermediate portion and from the free end portion of the first leg 20*a* toward the second leg 20*b*, both being in parallel with the web 20*c* and terminating at points spaced inwardly of the second leg 20*b*. The terminating face of the core member 21 serves as a support face 21*a* for supporting an armature 24 thereon; and that of the first pole piece 22 as a pole face 22*a*. The core member 21 is surrounded by a field coil 23 to form an electromagnet which, when excited, generates a magnetic flux for driving an armature 24 toward an actuated position. A permanent magnet 25 is magnetically connected to the second leg 20*b* of said yoke 20. The magnetic polarization direction of the permanent magnet 25 is such that the north pole is directed toward the second leg 20*b* and the south pole toward the opposite side. A second pole piece 26 is, at its upper surface, in contact with and magnetically connected to the south pole of said permanent magnet 25. The lower surface of the second pole piece 26, or a pole face 26*a*, is spaced from and confronts the pole face 22*a* of the first pole piece 22 to define an air gap therebetween. The base portion 24*a* of the armature 24 is pushed against the support face 21*a* of the core member 21 by a supporter 27 so as to be pivotally supported at portion shown at <R> in FIG. 4 on the support face 21*a* to allow pivotal movement thereof. The middle portion 24*b* of the armature 24 is extended through the air gap between the pole faces 22*a* and 26*a*. The free end portion 24*c* of the armature 24, allowed to move reciprocally, is intended for being in contact with a print wire 28 to be propelled down thereby for imprinting a dot when said field coil 23 is excited. First and second springs 29 and 30 are in contact with the armature 24 at the respective positions away from the fulcrum R. The first spring 29 is situated at the left side portion of the fulcrum R; and the second one 30 at the right side or free end portion 24*c* of the armature 24. These springs 29, 30 are both compression springs. Therefore, when the armature 24 stays in the reset position as shown in FIG. 4, the urging force of the second spring 30 is at its maximum, while that of the first spring 29 approaches its maximum as the armature moves to the actuated position. The urging force of 24 the springs 29, 30 are so determined that the first spring 29 overpowers the second spring 30 to bias the armature 24 toward the reset position after the armature 24 has been moved to the actuated position while it is counteracted by the second spring 30 when the armature 24 is in the reset position. The supporter 27, pushing the base portion 24*a* of the armature 24 against the support face 21*a*, is made of elastic material such as rubber. When the field coil 23 remains unexcited, a magnetic flux indicated by a solid line $F_1$ in FIG. 4 is generated by the magnetomotive force of the permanent magnet 25. The magnetic path for this magnetic flux $F_1$ begins at the permanent magnet 25, goes through the second leg 20*b*, the web 20*c*, the first leg 20*a*, the core member 21, the armature 24, the second pole piece 26, and returns to the permanent magnet 25. The armature 24 is attracted toward the second pole piece 26 due to the magnetic attraction force caused by this magnetic flux $F_1$. On the contrary, when the field coil 23 receives a driving voltage for generating a magnetomotive force opposite to and larger than that generated in the armature 24 by the permanent magnet 25, a magnetic flux indicated by a dotted line $F_2$ penetrating the main part of the yoke 20 and a magnetic flux indicated by another dotted line $F_3$ penetrating the first pole piece 22 are generated. The magnetic path for the magnetic flux $F_2$ begins at the core member 21, goes through the first leg 20*a*, the web 20*c*, the second leg 20b, the permanent magnet 25, the second pole piece 26, the armature 24, and returns to the core member 21. The magnetic path for the magnetic flux $F_3$ begins at the core member 21, goes through the first leg 20*a*, the first pole piece 22, the armature 24, and returns to the core member 21.

When the coil 23 is energized, the magnetic flux $F_2$ which is opposite in direction to the flux $F_1$ resulting from the permanent magnet 25 will appear between the armature 24 and the second pole piece 26 to cancel the flux $F_1$ such that the armature 24 is no more subject to the attracting force by the permanent magnet 25, and simultaneously the magnetic flux $F_3$ which is also opposite to the flux $F_1$ will appear between the armature 24 and the first pole piece 22 for attracting or moving the armature 24 to the first pole piece 22. In other words, at the initial stage of the energization of the coil 23 the flux $F_2$ generated in the armature 24 will cancel the flux $F_1$ by the permanent magnet 25 so as to make the armature 24 free from the permanent magnet 25 and at the subsequent stage the flux $F_3$ generated in the armature 24 will cause the armature 24 which has been out of influence by the permanent magnet 25 to be strongly attracted to the first pole piece 22, although the above stages occur simultaneously. Thus, upon the energization of the coil 23, the armature 24 is strongly and instantaneously attracted to the actuated position from the reset position. At this time, the free end portion 24*c* gives an impact to the print wire 28. And when the field coil 23 is de-energized, the armature 24 returns to its initial or reset position.

Figure 11:
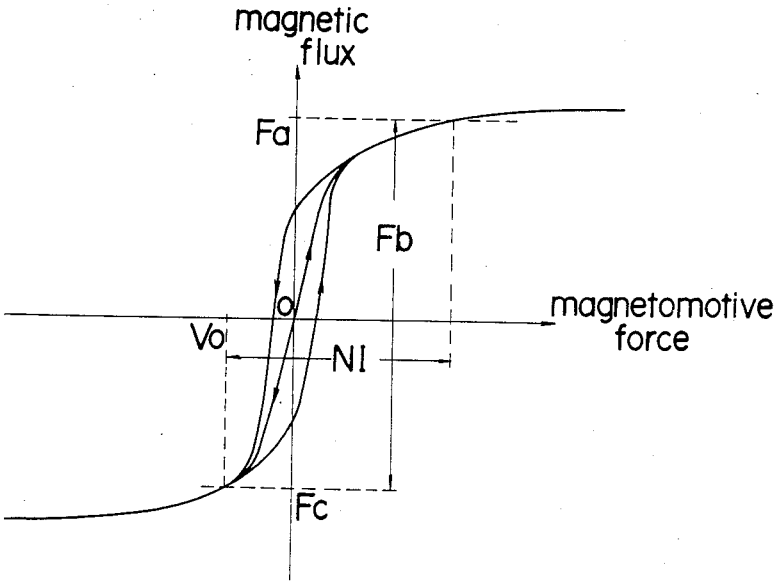
FIG. 11 is a diagram showing the relationship between the magnetic flux and the magnetomotive force in the above embodiment.

The relationship between the magnetic fluxes and the magnetomotive force generated by the field coil 24 and the permanent magnet 25 within the armature 24 is shown in FIG. 11. In the figure, <NI> shows the magnetomotive force generated by the field coil 23; and <Vo> shows that of the permanent magnet 25. When the field coil 23 is de-energized, the total magnetomotive force becomes negative, which reduces the magnetic flux in the armature 24 down to <Fc>. When the field coil 23 is energized, the total magnetomotive force becomes positive, which increases the magnetic flux in the armature 24 up to <Fa>. Therefore, the permitted range of the magnetic flux in the armature 24 is broadened to become as large as <Fb> which is more than that obtained in the prior art. Accordingly, the thickness of the armature 24 can be reduced while allowing sufficient magnetic fluxes therein, which effectuates the rapid response of the armature 24 owing to the mass reduction thereof, under the retention of attaining the magnetic attraction force at a sufficient level as obtained in the prior art.

The first spring 29 is employed for urging the armature 24 when it is in the actuated position toward the reset position and is cooperative with the permanent magnet 25 to return the armature 24 to the reset position against possible residual force acting between the armature 24 and the first pole piece 22 to retain the armature 24 in the actuated position. The urging force of the first spring 29 to the armature 24 is only necessary at the initial motion of the armature 24 returning from the actuated position to the reset position, and therefore it should not act on the armature 24 in the reset position since such urging force in the direction toward the reset position will certainly require more electromagnetic force for actuating the armature 24. It is for this reason that the second spring 30 is employed and arranged to counterbalance or overpower the first spring 29 when the armature 24 is in the reset position. By the above combination of the first and second springs 29 and 30, the armature 24 is allowed to rapidly move between the reset and actuated positions upon energization and de-energization of the coil 23 and at a minimum current requirement.

Figure 12:
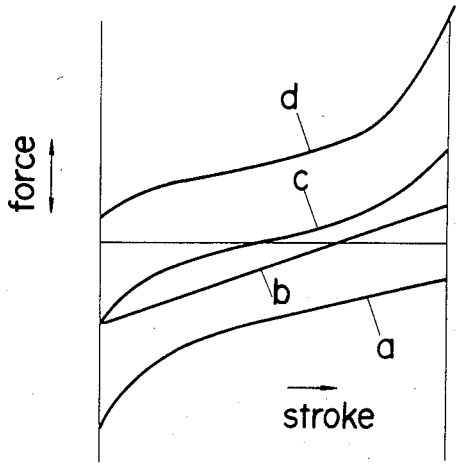
FIG. 12 is a diagram showing the relationship between the armature stroke and several forces applied thereto in the above embodiment.

The relationship between the armature stroke and several forces applied thereto in the present embodiment is shown in FIG. 12. In the figure, a curve <a> stands for the attraction force by the permanent magnet 25, a curve <b> stands for the composite force of the first and the second springs 29 and 30, a curve <c> stands for the composite attraction force of the permanent magnet 25 and the electromagnet when the armature 24 is released from the second pole piece 26, and a curve <d> stands for the attraction force when the field coil 23 is at its rated energization. The curve <b> is made negative for easy understanding of the interrelation with the other curves.

Figure 1:
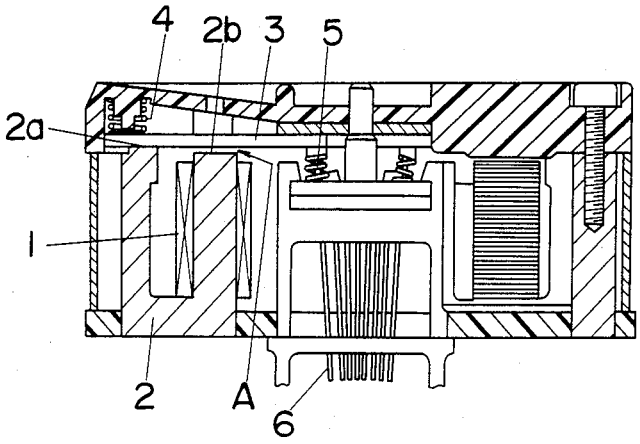
Fig. 1 (PRIOR ART)
FIG. 1 is a longitudinal sectional view of the main part of a conventional wire matrix impact print head.
Figure 2:
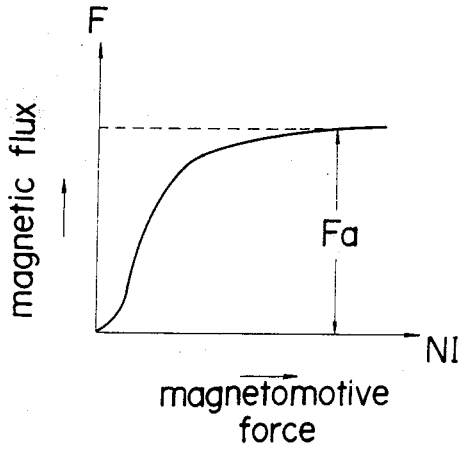
Fig. 2 (PRIOR ART)
FIG. 2 is a diagram showing the relationship between the magnetic flux and the magnetomotive force in a conventional non-polarized magnetic actuator employed in the above wire matrix impact print head.
Figure 3:
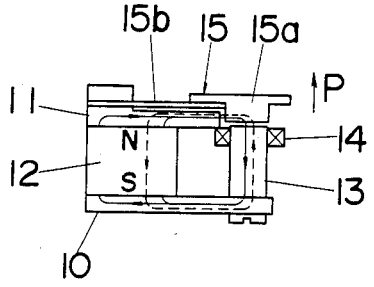
Fig.3 (PRIOR ART)
FIG. 3 is a schematic illustration of a conventional polarized magnetic actuator.
Figure 13:
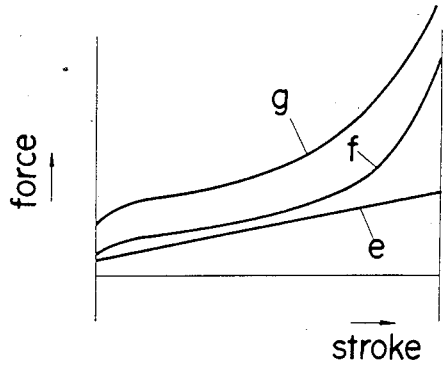
FIG. 13 is a diagram showing the relationship between the armature stroke and several forces applied thereto in the conventional magnetic actuator.

FIG. 13 shows, in contrast to the above response characteristic of the armature in accordance with the present invention shown in FIG. 12, the like response characteristic of the conventional non-polarized magnetic actuator with the restoring spring 4 at the base portion of the armature 3 as illustrated in FIG. 1. In the figure, a curve <e> stands for the spring load of the restoring spring 4, a curve <f> stands for the critical attraction force required for actuating the armature 3, and a curve <g> stands for the attraction force at the rated energization of the field coil 1. The curve <e> is made negative in order to facilitate the comparison with other curves.

Figure 5:
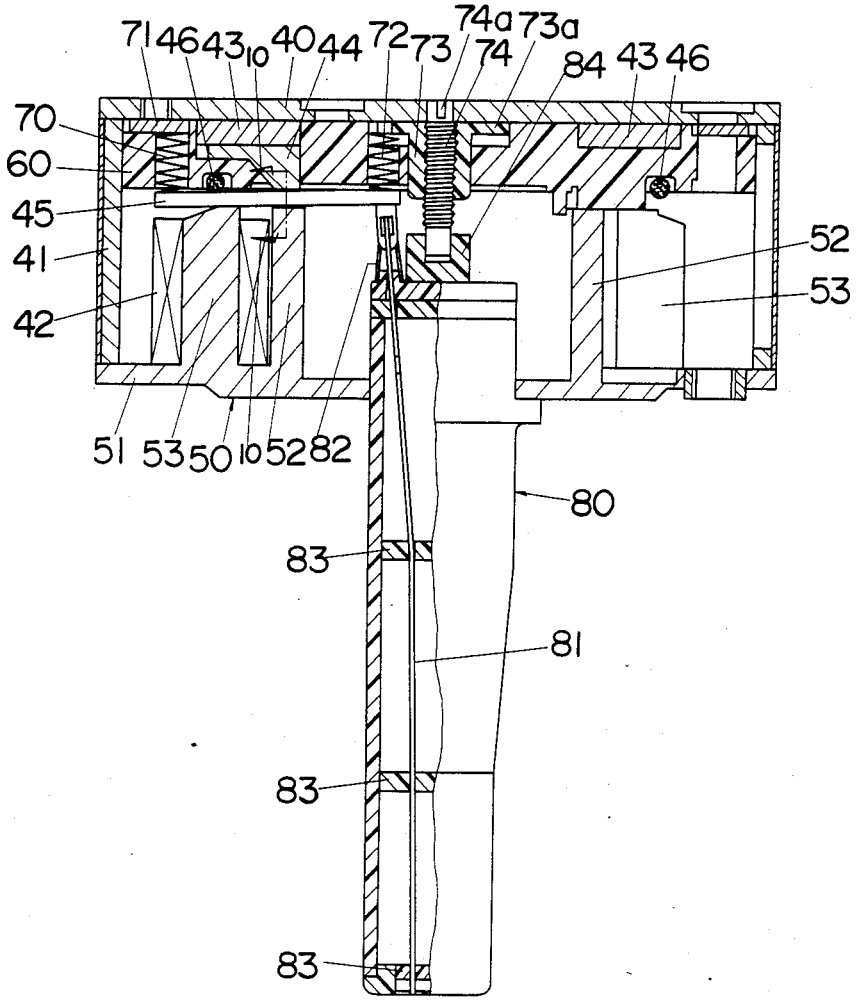
FIG. 5 is a longitudinal sectional view showing a wire matrix impact print head employing the above magnetic actuator mechanism.
Figure 6:
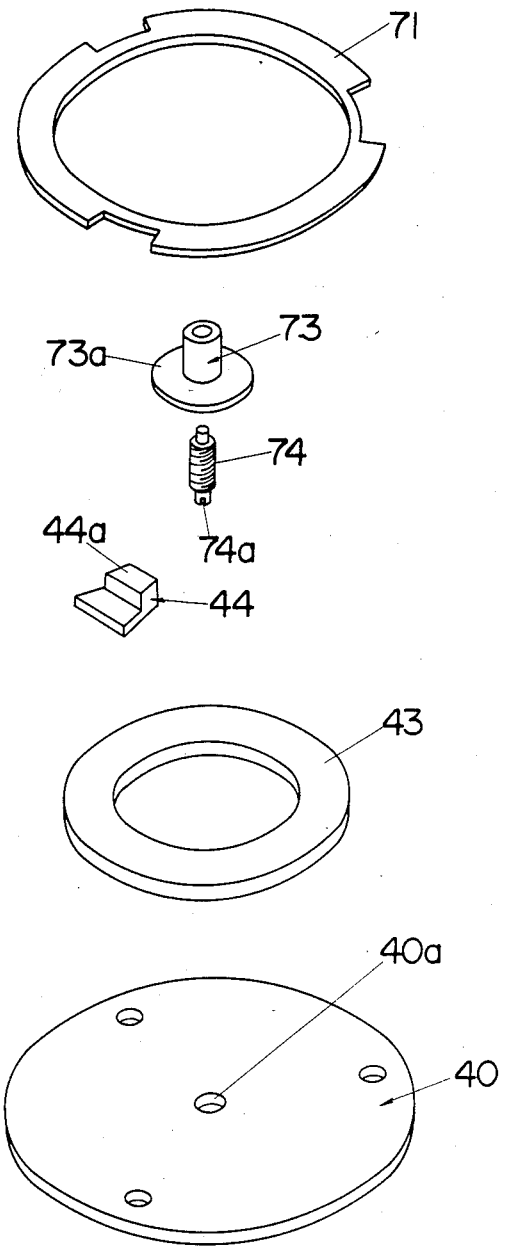
FIGS. 6, 7 and 8 are exploded perspective views showing the respective members of the above print head.
Figure 7:
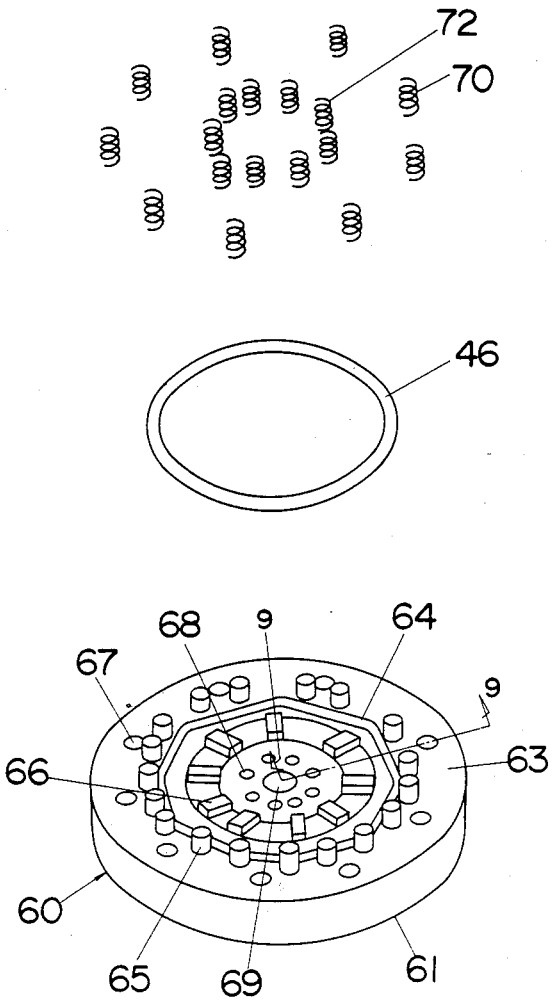
Figure 8:
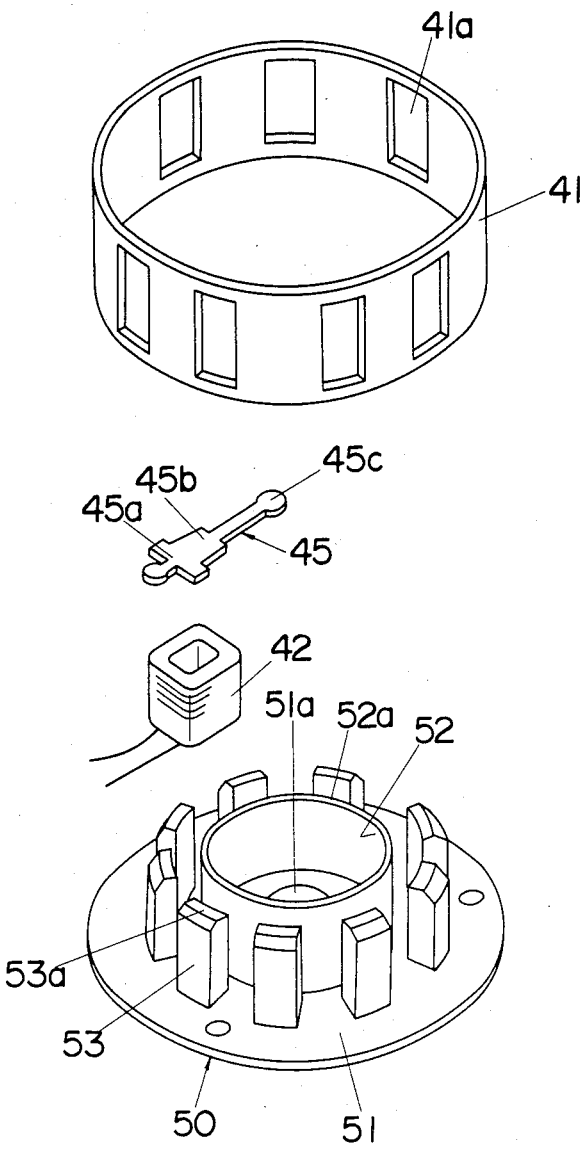
Figure 9:
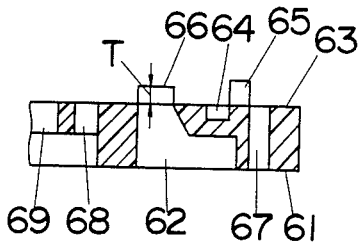
FIG. 9 is a longitudinal sectional view of a holder employed in the above print head taken on line 9—9 of FIG. 7.
Figure 10:
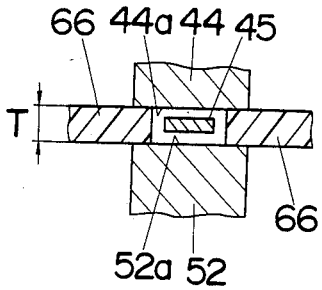
FIG. 10 is a longitudinal sectional view of the above print head taken on line 10—10 of FIG. 5.

FIGS. 5 through 10 illustrate the print head of a wire dot impact printer employing the above magnetic actuator mechanism. As shown in FIGS. 5 and 6, an upper yoke 40 is generally of disk-shaped configuration and is provided at its center with a penetrating hole 40*a*. This upper yoke 40 corresponds to the second leg 20*b* in FIG. 4. A side yoke 41 as best shown in FIG. 8 is generally of cylindrical configuration and is magnetically connected to said upper yoke 40 and a base yoke 50. The side yoke 41 is provided with a plurality of rectangular penetrating holes 41*a* in order to improve the heat radiation and make the weight light. This side yoke 41 corresponds to the web 20*c* in FIG. 4. The base yoke 50 comprises a lower yoke 51 of disk-shaped configuration, an internal iron core 52 of cylindrical configuration, and a plurality of external iron cores 53 equally spaced circumferentially along an imaginary outer circle which is coaxial with said internal iron core 52 and spaced therefrom. These iron cores 52 and 53 extend upwardly and terminate at portions well below the upper yoke 40. The upper surface of the internal iron core 52 defines a pole face 52*a* and that of each external iron core 53 defines a support face 53*a* to support an armature 45 thereon. The lower yoke 51 is provided at its center with a penetrating hole 51*a* into which one end portion of a wire block 80 is inserted. In the present embodiment, said iron cores 52 and 53 are integrally formed with the lower yoke 51 to present said base yoke 50 as by casting. The lower yoke 51, the external iron core 53 and the internal iron core 52 correspond respectively to the first leg 20*a*, the core member 21, and the first pole piece 22 in FIG. 4. A field coil 42 is fixed on the external iron core 53 of said base yoke 50 in such a manner as to surround the same. Returning back to FIG. 6, a permanent magnet 43 is in the shape of an endless ring plate. The magnetic polarization direction is generally perpendicular to the plate surface. One magnetic pole of the permanent magnet 43 is in contact with and magnetically connected to said upper yoke 40; and the other magnetic pole of the same is in contact with a plurality of circumferentially spaced pole pieces 44, each corresponding to each one of the armatures 45. The upper surfaces of the respective pole pieces 44 are in contact with and magnetically connected to the pole face of said permanent magnet 43; and the lower surfaces of the same defines pole faces 44*a* which is spaced from and confronting the pole face 52*a* of the internal iron core 52 of said base yoke 50. The pole pieces 44 are held in place by means of a holder 60 as best shown in FIG. 7. Each armature 45 is in contact with the support face 53*a* of the corresponding external iron cores 53 at its base portion 45*a*. The base portion 45*a* is supported onto the support face 53*a* by a ring 46 made of elastic material such as rubber. The middle portion 45*b* of the same is situated between the pole piece 44 and the internal iron core 52. The free end portion 45*c* of the same is in contact with the top end portion of a print wire 81. The base portion 45*a* and the free end portion 45*c* of the armature 45 are urged by first and second compression springs 70, 72. A first spring base 71 is, as shown in FIG. 6, of endless ring-shaped configuration and is disposed at the outer periphery of said ring-shaped permanent magnet 43. The upper surface of the first spring base 71 is fixed to the upper yoke 40; and the lower surface of the same is in contact with the first springs 70. The first springs 70 are situated between said first spring base 71 and the respective armatures 45. Each first spring 70 inflicts an urging force on the base portion 45*a* of each armature 45. The second springs 72 are situated between the armatures 45 and the flange 73*a* of a second spring base 73. Each second spring 72 inflicts an urging force on the free end portion 45*c* of each armature 45. Namely, both springs 70 and 72 apply urging forces to the armature 45 at the positions on both sides of the fulcrum of the armature 45. The ring 46 shown in FIG. 7 pushes the base portions 45*a* of the individual armatures 45 against the support faces 53*a* of the external iron cores 53 of the base yoke 50 and serves to pivotally support the armatures 45 on the respective support faces 53*a*. The holder 60 is made of plastics in a circular shape. The upper surface 61 of the holder 60 is in contact with said upper yoke 40. A concave portion 62 in the upper surface of the holder 60 shown in FIG. 9 is for receiving therein the ring shaped permanent magnet 43 and a plurality of pole pieces 44 in an easy and secure positioning manner. Said ring 46 is deformed to be force fitted in a polygonal groove 64 provided in the lower surface 63 of the holder 60, so that each one straight side of the ring 46 thus contoured in the form of the polygon abuts against the base portion 45*a* of each armature 45 for secure support thereof. This makes the movement of the armature 45 smooth, as compared with the case in which the ring 46 would remain undeformed to support the base portions 45*a* of the armatures 45 by the arcuate segments. In addition, the holder 60 is provided in its lower surface 63 with a plurality of circumferentially spaced projections 65 arranged on a circle for guiding the armature 45. Besides, a plurality of projections 66 are formed inside of the polygonal groove 64. These projections 66 are arranged on a circle to be spaced circumferentially. The upper surfaces of the adjacent projections 66 are, as shown in FIG. 10, in contact with the pole face 44*a* of the respective one of the pole pieces 44; and the lower surfaces of the same in contact with the pole face 52*a* of the internal iron core 52. Namely, the gaps between the respective pole faces 44*a* and 52*a* can be well determined by the strict control of the thickness T of the projection 66. Therefore, uneven strokes of the armatures 45 of different positions can be avoided. Returning back to FIG. 7, the present holder 60 is provided at the respective positions corresponding to the free end portion 45*c* and the base portion 45*a* of the armature 45 with holes 67, 68 for seating the first and the second springs 70, 72 therein. The holder 60 is provided at its center with a hole 69 through which the second spring base 73 penetrates. A spring load adjusting screw 74 is screwed in the second spring base 83 for moving vertically the spring base 83 relative to the holder 60 by rotation thereof. The screw 74 is for adjusting the spring load on the respective armatures 45 to improve the armature operation. The upper side of the screw 74 is rotatably supported within the penetrating hole 40*a* at the center of said upper yoke 40. The lower side of the same is journaled in the bearing portion 84 at the top of the wire block 80. This screw 74 is provided at its top with a groove 74*a* which is accessible to the user for adjusting the spring load on the armature 45. The second spring base 73 is provided at its upper end with the flange 73*a* which is in contact with the upper end of the second springs 72. Accordingly, the adjustment of the urging force of the second springs 72 is allowed by the vertical movement of the second spring base 73. The wire block 80 in FIG. 5 comprises a plurality of print wires 81, a plurality of wire returning springs 82 cooperative therewith, guide members 83 for disposing the print wires 81 at predetermined positions, and the bearing portion 84 for supporting the lower end of said spring adjusting screw 74. The upper portions of the print wires 81 are arranged in a circle so as to be coincident with said respective armatures 45. The lowermost portion of each print wire 81 is for imprinting a dot on the recording medium.

The print head can be easily assembled according to the following order. Firstly, mount the permanent magnet 43 and the respective pole pieces 44 onto the upper yoke 40, mount thereon the second spring base 73 with the spring adjusting screw 74, and the first spring base 71. Then, fix the holder 60 on the upper yoke 40 to hold said parts in the correct positions. Thereafter, insert the first and the second springs 70, 72, the ring 46, and the armature 45 into the holder 60. Fix on the upper yoke 40 the base yoke 50 together with the side yoke 41 and with the field coil 42. Connect the wire block 80 on the base yoke 50. Thus, the print head can be assembled only through the operation of successively adding the parts to the upper yoke 40. Therefore, in the present invention, the print head is easy to assemble.

Figure 14:
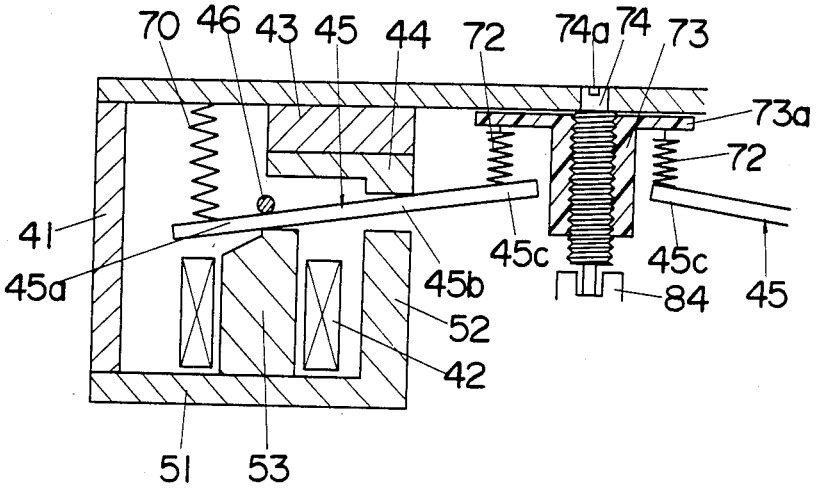
FIG. 14 is a longitudinal sectional view of a spring adjusting means employed in the print head shown in FIGS. 5 through 10.
Figure 15:
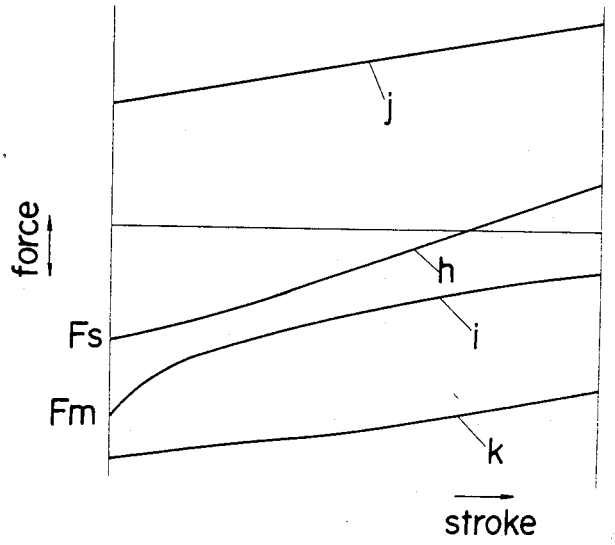
FIG. 15 is a diagram showing the relationship between the armature stroke and several forces applied thereto in the above spring adjusting means.
Figure 16:
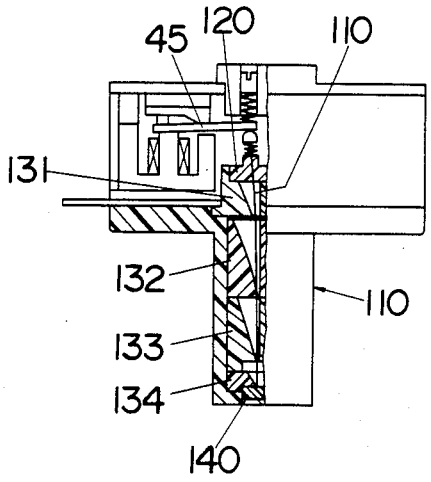
FIG. 16 is a partly sectional side elevation of an improved print head employing the above magnetic actuator mechanisms.

Further, in this print head, the urging force of the second springs 72 can be adjusted all at the same time, as the print head is provided at its center with spring adjusting means comprising a spring adjusting screw 74 and the second spring base 73, as shown in FIG. 14. The relationship between the armature stroke and the force applied thereto is shown in FIG. 15. In the figure, a curve <h> stands for the composite spring load of the first and the second springs 70 and 72, a curve <i> stands for the attraction force of the permanent magnet 43, a curve <j> stands for the spring load of the first spring 70, and a curve <k> stands for the spring load of the second spring 72. The curve <i> is made negative for facilitating the comparison with other curves. Further, a point <Fs> stands for the composite spring force when the armature is at zero stroke, and a point <Fm> stands for the magnetic attraction force of the permanent magnet 43 at that condition. In principle, the points <Fm> and <Fs> should be maintained at constant values in order to operate the armature 45 by the predetermined energization level of the field coil 42. But the magnetic attraction force of the permanent magnet 43 is liable to become uneven among different lots, which is responsible for the variations in response characteristic of the armatures in different print heads. In order to obviate this drawback, in the present print head, the point <Fs> is made adjustable by rotating the spring adjusting screw 74 and varying the urging force by the second coiled springs 72 applied to the armatures 45. Therefore, the armatures 45 are so adjustable as to move at a constant energization level of the field coil 42.

Figure 17:
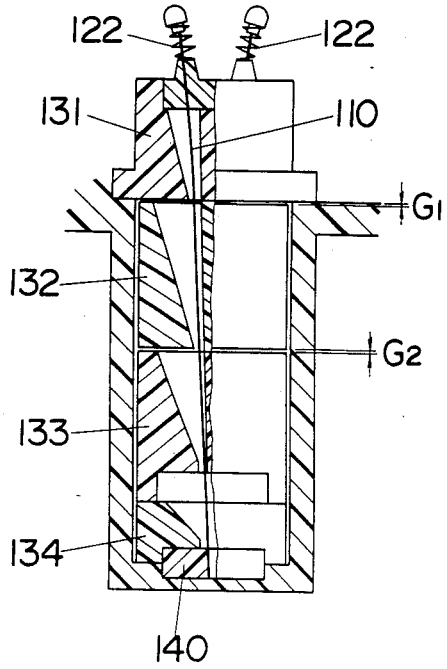
FIG. 17 is a partly sectional side elevation of a wire block employed in the above print head.
Figure 18:
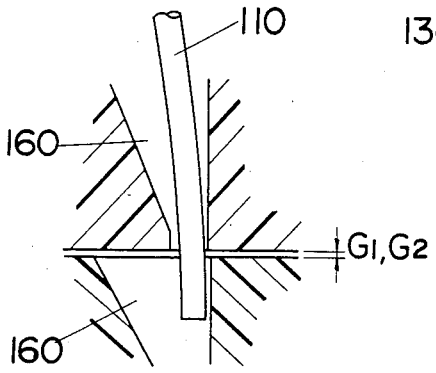
FIG. 18 is an enlarged longitudinal sectional view of the above wire block.
Figure 19:
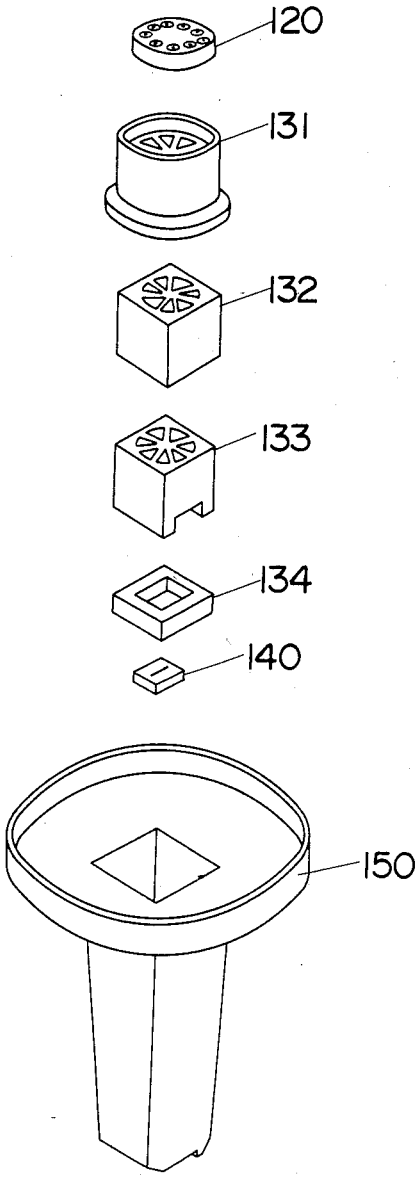
FIG. 19 is an exploded perspective view showing the respective members of the above wire block.
Figure 20A:
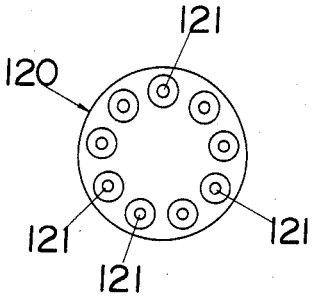
FIG. 20A is a top plan view of a top support plate in the above wire block.
Figure 20B:
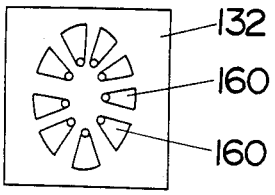
FIG. 20B is a top plan view of a wire guide in the above wire block.
Figure 20C:
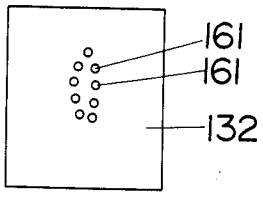
FIG. 20C is a bottom view of the above wire guide.
Figure 20D:
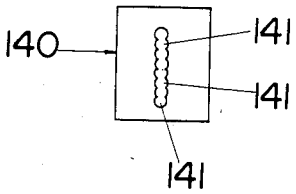
FIG. 20D is a bottom view of a bottom support plate in the above wire block.

FIGS. 16 through 20 show an improved print head in accordance with another modification of the above embodiment. In this print head, each wire guide has specifically designed guide holes of tapered shapes, which makes the wire insertion easier in assembling the print head. A wire block 100 comprises a plurality of print wires 110, a top support plate 120, a plurality of wire guides 131 through 134 for guiding the print wires 110, a bottom support plate 140, and a wire housing 150 for containing these parts. The top support plate 120 is provided with a series of apertures 121 therethrough distributed in a circle at equidistance as shown in FIG. 20A. A plurality of print wires 110 are passed through the apertures 121 at an angle relative to the top support plate 120. Each print wire 110 is provided at its head with a compression spring 122, which biases the print wire 110 back into its reset position after the print wire 110 has been propelled at its head by the armature 45 to print a dot on the recording medium. The top support plate 120 and the wire guides 131 through 134 are made of plastics and the like. The wire guides 131 through 134 are provided with guiding holes 160 to guide the print wires 110 toward the center line of the wire housing 150. The gaps $G_1$ and $G_2$ formed between each wire guides, as shown in FIG. 18, are made as small as possible to prevent the print wires 110 from going into the gaps by mistake. The guiding holes 160 are of generally taper shapes as shown in FIG. 17. Therefore, the wire insertion in assembling the print head is made easier, as the misalignment of the guide holes 160 of the adjacent wire guides can be avoided. In other words, as the input holes of the guiding holes 160 are larger than the output holes thereof, the print wires 110 inserted from the upside have no obstruction to the insertion, and therefore, can be smoothly inserted. The output holes 161 are arranged generally on an imaginary ellipse as shown in FIG. 20C. The bottom support plate 140 is made of rigid material such as ceramics. The guiding holes 141 of the bottom support plate 140 are arranged generally on a straight line as shown in FIG. 20D.

Although the present invention has been described in its preferred embodiment, it should be understood by those skilled in the art that the present invention is not limited to the present embodiment and that various changes and modifications may be made without departing from the scope of the present invention.

What is claimed is:

1. A magnetic actuator mechanism comprising:

an armature movable between a reset position and an actuated position;

a permanent magnet which forms with said armature a resetting magnetic circuit for constantly attracting the armature to the reset position;

an electromagnet which forms with said armature an actuating magnetic circuit for generating in the armature a magnetic flux which is opposite to and larger than that generated in the armature by the permanent magnet such that the actuating magnetic circuit upon energization of the electromagnet will cause the armature to move to the actuated position, wherein said permanent magnet and electromagnet are included in a structure comprising a generally U-shaped yoke, first and second pole pieces, and a core member, said yoke comprising first and second legs connected by a web, said first and second pole pieces extending in spaced and generally parallel relation to the web of the yoke from said first and second legs in an approaching manner to define therebetween an air gap through which said armature extends, and said core member extending in spaced and generally parallel relation to the web from the intermediate portion of the first leg so as to be cooperative with a field coil wound therearound to define said electromagnet and terminating in a support face spaced inwardly from the second leg for pivotally supporting said armature, whereby the armature is held movable between said reset position where the armature bridges between the core member and the second pole piece to complete said reset magnetic circuit including therein said permanent magnet and the actuated position where the armature bridges between the core member and the first pole piece to complete said actuating magnetic circuit including said electromagnet.

2. The magnetic actuator mechanism as set forth in claim 1, wherein first and second springs are connected to the armature on both sides of the portion pivotally supported onto said support face of the core member in such a manner that the first spring overpowers the second spring to bias the armature toward the reset position after the armature has been moved to the actuated position while it is counteracted by the second spring when the armature is in the reset position.

3. The magnetic actuator mechanism as set forth in claim 2, including means for adjusting the biasing force of the second spring counteracting the first spring.

* * * * *